United States Patent [19]

Misevich et al.

[11] Patent Number: 4,897,937

[45] Date of Patent: Feb. 6, 1990

[54] NON-SLIP INSOLE BASE

[75] Inventors: Kenneth W. Misevich, Piscataway; Thomas E. Mintel, Somerset, both of N.J.

[73] Assignee: Colgate-Palmolive Company, Piscataway, N.J.

[21] Appl. No.: 100,062

[22] Filed: Sep. 23, 1987

[51] Int. Cl.[4] ..... A43B 13/38

[52] U.S. Cl. ..... 36/43; 36/3 B; 36/80; 128/581

[58] Field of Search ..... 36/43, 44, 3 B, 46, 36/71, 91, 80; 128/581, 582, 586, 614, 615

[56] References Cited

U.S. PATENT DOCUMENTS

| | | | |
|---|---|---|---|
| 2,217,882 | 10/1940 | Andersen | 36/44 X |
| 2,772,196 | 11/1956 | Pooley | 36/44 |
| 2,959,875 | 11/1960 | Frese Jr. | 36/43 X |
| 3,071,877 | 1/1963 | Stickles | 36/44 |
| 3,086,532 | 4/1963 | Mistarz | 128/586 |
| 3,143,812 | 8/1964 | Bittner | 36/44 |
| 3,220,416 | 11/1965 | Brown | 36/71 X |
| 3,595,244 | 7/1971 | Kugler | 128/582 |
| 4,075,772 | 2/1978 | Sicurella | 36/43 |
| 4,635,385 | 1/1987 | Odgen | 36/43 |
| 4,694,590 | 9/1987 | Greenawalt | 36/43 X |

FOREIGN PATENT DOCUMENTS

| | | | |
|---|---|---|---|
| 015482 | 9/1980 | European Pat. Off. . | |
| 135828 | 4/1985 | European Pat. Off. . | |
| 2716582 | 10/1978 | Fed. Rep. of Germany | 36/43 |
| 2845880 | 4/1980 | Fed. Rep. of Germany | 36/43 |
| 3503960 | 8/1986 | Fed. Rep. of Germany | 36/44 |
| 2539966 | 8/1984 | France | 36/43 |
| 362307 | 12/1931 | United Kingdom . | |
| 497545 | 12/1938 | United Kingdom . | |
| 509855 | 7/1939 | United Kingdom . | |
| 533437 | 2/1941 | United Kingdom . | |
| 763878 | 12/1956 | United Kingdom . | |
| 1297987 | 11/1972 | United Kingdom . | |
| 2102276 | 2/1983 | United Kingdom . | |

*Primary Examiner*—James Kee Chi

*Attorney, Agent, or Firm*—Richard J. Ancel; Robert C. Sullivan; Murray M. Grill

[57] ABSTRACT

An insole base member in planar form for providing a mechanical interlock with a shoe insole is disclosed. The insole base provides a low volume, low profile molded pattern which contacts the underside of the insole material and prevents shearing shifts of the insole. In one embodiment, the insole base has a smooth upper surface in the region adjacent the metatarsal heads of the foot, with a plurality of raised ridges extending transversely across the smooth upper surface, and with the upper surface of the insole base having a cross hatch pattern extending over the remainder of the base anterior and posterior to the smooth upper surface portion. The raised ridges may be positioned so as to lie parallel to the transverse and oblique metatarsal axes of the foot. In alternative embodiments, a plurality of raised ridges are positioned adjacent to the heel or the ball of the foot, with such raised ridges being located outwardly of a central reference point in a pattern corresponding to the spokes of a wheel.

5 Claims, 3 Drawing Sheets

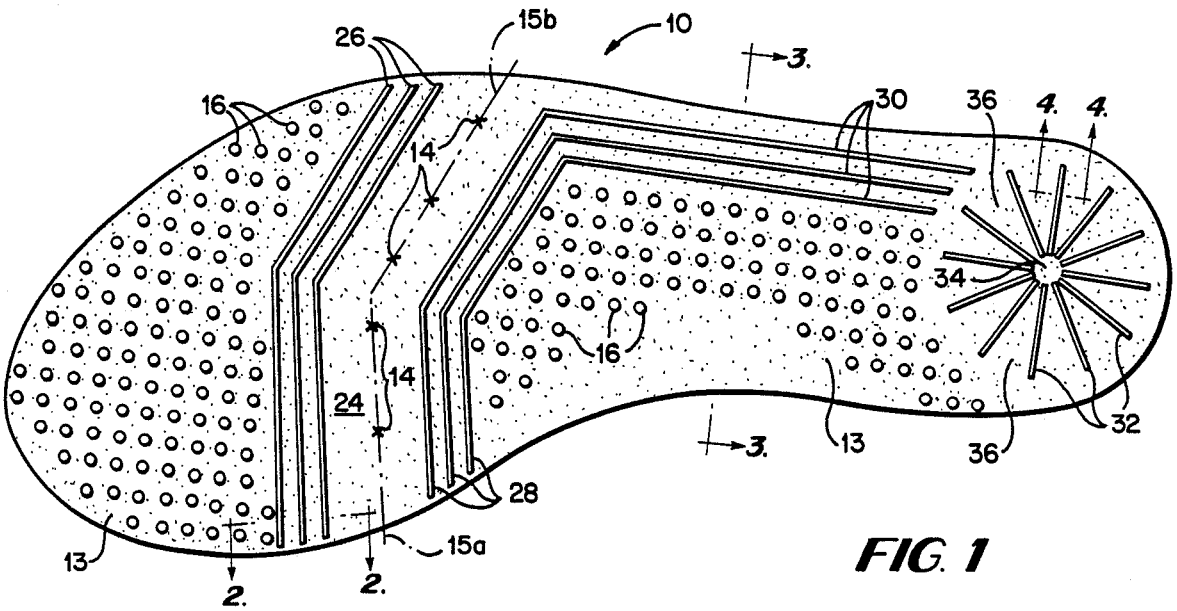
FIG. 1
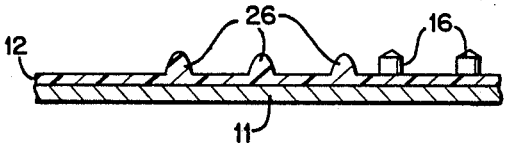
FIG. 2
FIG. 3
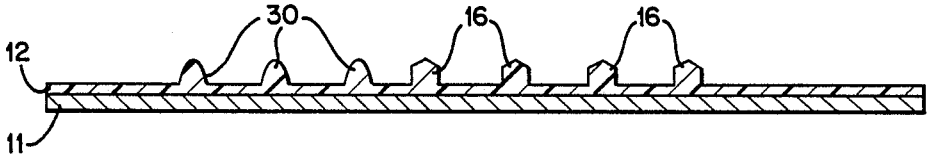
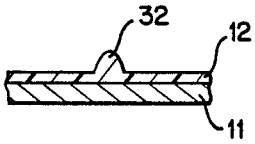
FIG. 4

FIG. 8
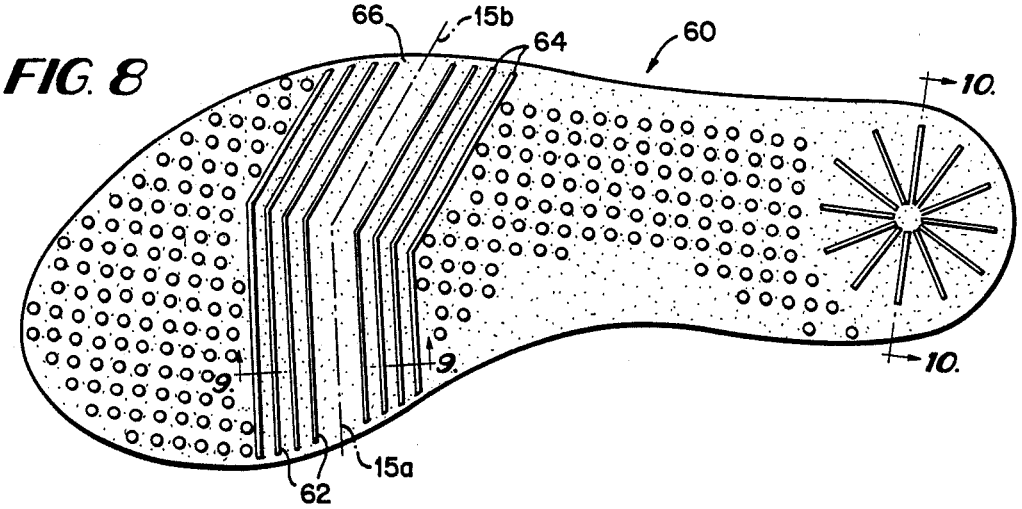
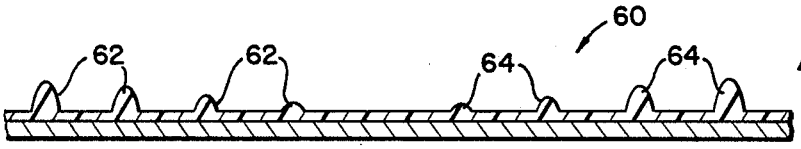
FIG. 9
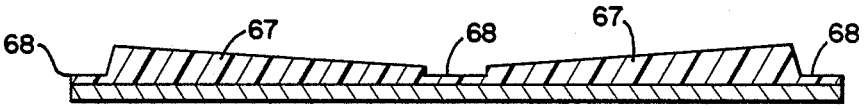
FIG. 10
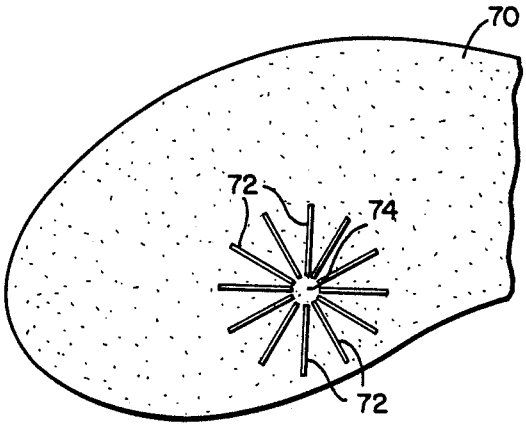
FIG. 11
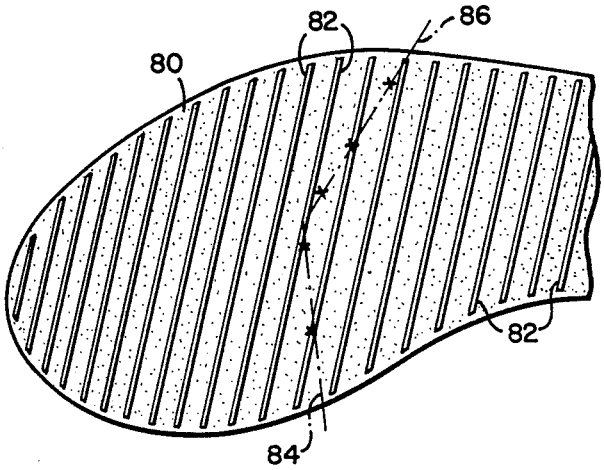
FIG. 12

NON-SLIP INSOLE BASE

BACKGROUND AND SUMMARY OF THE INVENTION

The present invention relates to a non-slip surface which serves as a base for the insole of a shoe construction. More particularly, the present invention relates to a non-slip surface which provides a mechanical interlock for effectively holding a shoe insole in place.

In an attempt to understand the foot as a system, the various parameters which affect the function of the foot have been studied, particularly with regard to a weight bearing foot. The practical need for such knowledge lies in the fact that a true structural model of the foot is capable of providing a prediction of gait and the effects of a shoe on gait. By knowing, in advance, how a shoe would affect the performance of an athlete, for example, optimum shoes could be designed without the usual "cut and try" method of standard shoe development.

The traditional model of the foot provides for a one column, two-axis model which maintains that the foot under load is a rigid structure with a talocrural (ankle) axis and an apparent subtalar axis. The front of the foot is relatively rigid, but with only a multitude of small bone movements about the midtarses axes. The average direction of the effective axis under the ankle, called the subtalar axis, is said to be 42 degrees vertical and 16 degrees horizontal to the midline of the body, as measured by Inman, V. T., *The Joints of the Ankle,* The Williams & Wilkins Co., Baltimore, 1976. However, this theory does not hold up with regard to a weight bearing or loaded foot since, if the force due to body weight were to act on the single traditional subtalar axis, the foot would collapse mechanically.

It has now been determined that the foot is comprised of two columns and three axes. The lower, lateral column is basically a rigid base comprised of the Calcaneus, Cuboid, and the fourth and fifth metatarsals. The remainder of the foot, which is comprised of the navicular, the first, second and third cuneiforms and the first, second and third metatarsals, emanates from the talus at the talonavicular interface swinging in combination with the lower column inversion/eversion actions in what may be called the 'subtalar joint axis'. But this articulation of what is called the upper foot column is only secondary to the true foot mechanism. The primary mechanical loading interface is on the lower, lateral column at the rear of the talus onto the calcaneus, the posterior talocalcaneal facet.

It has also been determined that the foot operates differently under load than when it is passively manipulated such as a doctor would do in the office. This distinction helps to explain previous misconceptions as to how the foot works under load.

This new understanding has yielded a new structural model of the foot which has two separate columns, wrapped together with fascia, and three nearly orthogonal axes. The three axes are: (1) the talocrural (ankle) axis; (2) the talocalcaneal axis (formed at the facet between the talus and the calcaneus); and (3) the talonavicular axis (formed at the facet between the talus and the navicular bones).

It has been traditional in the past for shoe insoles to be either glued into a shoe or to be placed inside the shoe upper with only shoe irregularities and fabric texture to interlock with the soft undersurface of the insole insert.

Thus in the past, the shifting and slipping of the insole within the shoe during use has been a common problem.

By the present invention, there is provided a non-slip base surface for a shoe insole in which a mechanical interlock between the base and the insole is used as the exclusive means for holding the insole in place. The insole base of the present invention provides a low volume, low profile molded pattern which penetrates the insole material and prevents shearing shifts. The present insole base can be molded directly onto the fabric of the upper material which forms the cover over the outsole or, alternatively, the pattern may be molded onto any suitable separate fabric sheet which can then be die cut to shape and permanently adhered to the bottom of the shoe.

Accordingly, it is an object of the present invention to provide a non-slip surface for a shoe insole based on mechanical locking as opposed to pure sliding friction or adhesives and stitching.

It is a further object of the invention to maximize interlock shear strength and to minimize material volume for an insole base, with the result that pattern directionality is related to dynamic shear forces and so that material and shape are related to properties of the insole.

It is another object of the invention to provide an insole base which is easily moldable to any shoe surface.

It is a further object of the invention to provide a permanent non-slip insole base which is effective for the life of the shoe.

BRIEF DESCRIPTION OF THE DRAWINGS

FIG. 1 is a top plan view of a non-slip insole base constructed in accordance with the present invention.

FIG. 2 is a cross sectional view taken along line 2—2 of FIG. 1.

FIG. 3 is a cross sectional view taken along line 3—3 of FIG. 1.

FIG. 4 is a cross sectional view taken along line 4—4 of FIG. 1.

FIG. 8 is a top plan view of another embodiment of the present invention.

FIG. 9 is a cross sectional view taken along line 9—9 of FIG. 8.

FIG. 10 is a cross sectional view taken along line 10—10 of FIG. 8.

FIG. 11 is a partial top plan view of another embodiment of the present invention.

FIG. 12 is a partial top plan view of a further embodiment of the present invention.

DESCRIPTION OF THE PREFERRED EMBODIMENT

Figure 5:
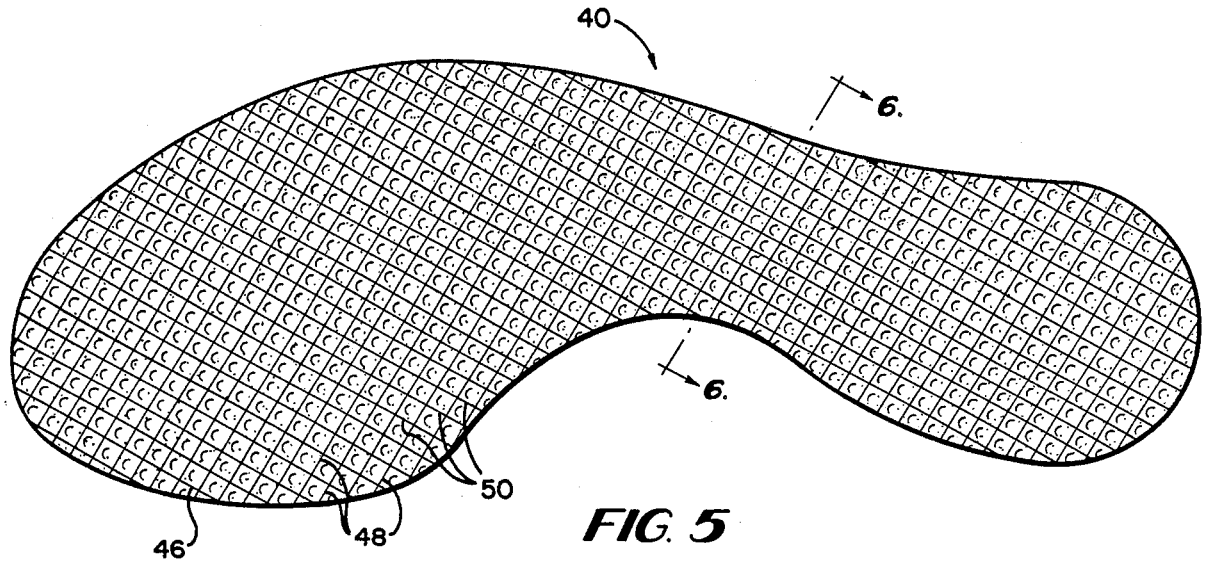
FIG. 5 is a top plan view of an alternative embodiment of the present invention.

In the embodiment of the invention as shown in FIGS. 1 through 4, there is provided a non-slip insole base 10 which includes a lower planar member 11 having a layer 12 of a relatively firm material directly molded to the upper surface thereof.

In one embodiment, the lower member 11 of the base 10 is made from a standard shoe upper leather with a direct molded polyurethane upper layer 12. The lower layer 11 can be of any flexible, thin material which has good adhesive properties. The upper portion 12 can be of any easily moldable semi-rigid material that is durable and strong.

The layer 12 is provided with a suitable cross hatch pattern 13 in the forefoot and midfoot regions. The geometry of the cross hatch pattern 13 may be varied depending on the desired function for the shoe. Thus the most predominant movements and shear loading must be anticipated for the particular sport or activity in which the shoe is to be used and a cross hatch pattern selected accordingly. In addition, the pattern geometry and material properties may change according to the type of insole which is to be used, such as, for example, a foam, leather or other type insole. As shown in FIGS. 1 through 4, the cross hatch pattern 13 in one embodiment may be in the form of a series of rows of semi-rigid cylindrical or conical pegs 16 extending upwardly from the surface of the layer 12. In another embodiment, the cross hatch pattern 13 may be in the form of a series of parallel ridges which intersect at right angles with a second series of parallel ridges, with the ridges having a sharply edged upper surface to facilitate penetration of the insole. The cross hatch pattern 13 may be eliminated on the extreme medial side in the midfoot region as shown, thus providing a flat, smooth surface in this region.

The insole base 10 is in the general shape of the bottom of a foot. In one embodiment, as shown in FIG. 1, a computer was employed to collect data so as to project a foot of average size and shape. The average measurements provided a location for the five metatarsal heads 14. The metatarsal heads 14 are positioned on axes passing transversely across the foot, including transverse metatarsal axis 15*a* which forms a straight line from the medial side of the foot through the heads of the first and second metatarsals, and oblique metatarsal axis 15*b* which is angled posteriorly from axis 15*a* to form a straight line through the third, fourth and fifth metatarsals.

In the region of the base 10 proximate and adjacent to the metatarsal heads 14, the upper layer 12 of the base 10 is provided as a flat, smooth surface 24 extending transversely across the base 10 from the medial to the lateral side thereof. The boundaries of the flat, smooth surface 24 on the anterior and posterior sides thereof extend generally parallel to the axes 15*a* and 15*b* of the metatarsal heads 14. Commencing at both the anterior and posterior edges of the smooth surface 24, a series of raised ridges 26, 28 are provided on the respective anterior and posterior regions of surface 24.

Each anterior ridge 26, shown in cross section in FIG. 2, extends transversely across the base 10 in a direction generally parallel to the axes 15*a*, 15*b* of the metatarsal heads 14. In one embodiment, a series of three anterior ridges 26 was employed with good results.

In a similar manner, the posterior ridges 28 extend generally parallel to the axes 15*a*, 15*b* beginning at the medial side of the base 10 and extending toward the lateral side. However, before reaching the lateral side of the base 10, the ridges 28 are intersected by a series of raised ridges 30 which extend along the lateral side of the base 10 generally parallel to the lateral edge thereof. These ridges 30, shown in cross section in FIG. 3, extend posteriorly so that the posterior ends thereof are in proximity to the heel region of the base 10. These ridges 30 are beneficial in preventing the insole from riding up the side of the shoe. In one embodiment, a series of three posterior ridges 28 and three lateral ridges 30 was employed with good results.

The interval between adjacent ridges may be of any suitable dimension which produces the desired effect in holding the insole in place. In one embodiment, an interval of about 3/16 inch was employed between adjacent anterior ridges 26 and also between adjacent posterior ridges 28 as well as between adjacent lateral ridges 30.

In the heel region of layer 12, a series of ridges 32 is provided in which the ridges 32 extend outwardly from a central heel reference point 34 in the pattern of the spokes of a wheel. The portion 36 of the base 10 between the heel ridges 32 is of generally flat, smooth configuration, as shown in FIG. 4.

The height of the ridges 26, 28, 30 should be selected so as to assist in providing a mechanical interlock with the insole while maintaining a relatively low profile. In one embodiment the height of the ridges 26, 28, 30 was approximately the same as the height of the pegs or ridges of the cross hatch pattern 13. This height may be approximately 1/32 to 3/32 inch, for example. The overall purpose of the insole base 10 is to provide a surface which will maintain the insole in place once it is positioned properly, and to avoid slipping or shifting of the insole during movement of the foot, even while the wearer is engaged in vigorous activity.

Figure 6:
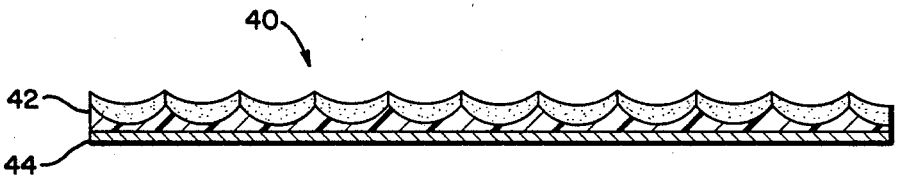
FIG. 6 is a cross sectional view taken along line 6—6 of FIG. 5.

In the embodiment as shown in FIGS. 5 and 6, there is provided an insole base 40 with upper 42 and lower 44 layers, in which a cross hatch pattern 46 is distributed over the entire upper surface area of upper layer 42. The cross hatch pattern 46 may be the same as that employed in the embodiment of FIG. 1. Thus the pattern 46 may be in the form of a series of parallel ridges 48 which intersect at right angles with a second series of parallel ridges 50, with the ridges 48, 50 having a sharply edged upper surface to facilitate penetration of the insole Alternatively, the cross hatch pattern 46 may be in the form of a series of rows of semi-rigid cylindrical or conical pegs extending upwardly from the upper surface of the base 40.

In a modification of the embodiment of FIGS. 5 and 6, the layer 42 may have a smooth upper surface in the regions subject to increased pressure, including the regions under the heel, the lower column and the metatarsal heads. Such smooth regions form a pattern similar to a footprint, with the remaining portion or the upper surface of layer 42 having the cross hatch or peg pattern as previously described.

Figure 7:
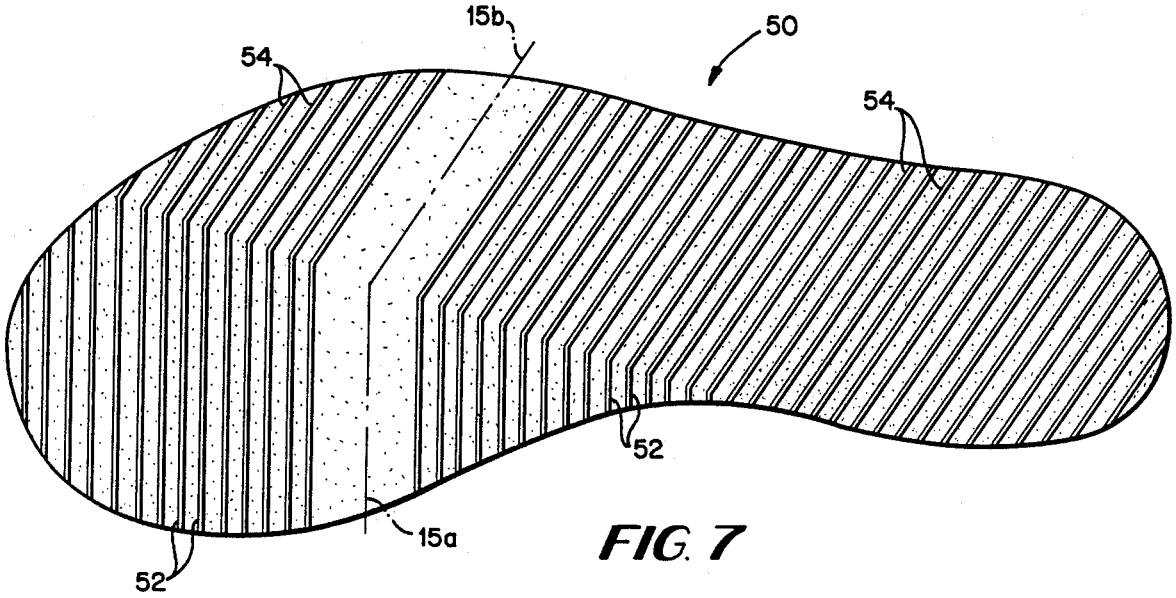
FIG. 7 is a top plan view of a further embodiment of the present invention.

In the embodiment of FIG. 7, the insole base 50 is provided with a series of generally parallel ridges 52 and 54. On the medial side of the base 50, the ridges 52 are parallel to the transverse metatarsal axis 15*a*, while on the lateral side of the base 50, the ridges 54 are parallel to the oblique metatarsal axis 15*b*. The ridges 52, 54 are of the same general configuration as the ridges 26, 28 in the embodiment of FIG. 1. The height of the ridges 52 and 54 should be reduced in regions of high pressure, including the lateral border and the heel region.

As shown in FIGS. 8 and 9, there is provided an insole base 60 having a series of raised ridges 62, 64 on the respective anterior and posterior regions of otherwise smooth surface 66 in the region proximate and adjacent the metatarsal heads. These ridges 62, 64 extend in a direction generally parallel to the transverse 15*a* and oblique 15*b* metatarsal axes. The ridges 62, 64 can be of varying height so that, for example, the extreme anterior ridge of the anterior ridges 62 is of the greatest height, as shown in FIG. 9, and each successive anterior ridge 62 in the direction of the metatarsal axes 15*a*, 15*b* is of a lesser height than the previous ridge 62. The posterior ridges 64 are of varying height in a similar pattern in this embodiment. In this manner, the ridges form a cupping pattern in the region directly under the metatarsal heads, thus providing a cupping support under the weight bearing portion of the forefoot.

A cup-type configuration can also be provided in the heel area. As shown in FIGS. 8 and 10, the ridges 67 have their greatest height at the ends most remote from the central heel area and the ridges 67 slope downwardly toward the center of the heel area, with the upper surfaces of the ridges 67 being either planar as shown or concave, and with the upper layer 68 of the insole base 60 being located in the central heel area and also outwardly of the ridges 67. This cup-type configuration assists in providing support and stability to the rearfoot region.

In the embodiment of FIG. 11, the upper surface of outsole 70 is provided with a series of ridges 72 arranged so as to extend outwardly from a central reference point 74 located in the region of the ball of the foot and proximate and adjacent to the metatarsal heads. These ridges 72 may be of uniform height along the length thereof or, alternatively, the ridges 72 may slope downwardly as in the case of the previous embodiment to provide a cupping pattern.

The embodiment of FIG. 12 includes an outsole 80 which is provided with a plurality of spaced parallel ridges 82 extending over the surface of the outsole 80 and arranged so as to be parallel to an average axis of the transverse 84 and oblique 86 metatarsal axes. Such an average axis may be obtained by measuring the foot structure of a large number of people to determine the average transverse and oblique metatarsal axes. The bisector of the angle formed by the average transverse and oblique metatarsal axes is next determined and the ridges 82 are then formed perpendicular to the bisector of the angle, thus being parallel to an average axis of the transverse and oblique metatarsal axes.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An insole base to be positioned below a shoe insole to provide a non-slip surface for receiving said shoe insole in a shoe construction, comprising:

a show sole member having an upper surface in the shape of the bottom of a foot with a medial side and a lateral side, said upper surface having a smooth surface portion in the region proximate and adjacent to the location of the metatarsal heads of said foot, at least one raised ridge positioned in the upper surface of said sole member anterior to said smooth surface portion and at least one raised ridge positioned in the upper surface of said sole member posterior to said smooth surface portion, each raised ridge extending from the medial side of the sole member in a direction generally parallel to the transverse metatarsal axis which passes through the first and second metatarsal heads of the foot and with each said raised ridge then being angled so as to extend toward the lateral side of the sole member in a direction generally parallel to the oblique metatarsal axis which passes through the third, fourth and fifth metatarsal heads.

2. The insole base of claim 1 wherein said sole member serves to provide a mechanical interlock when engaged with a shoe insole overlaid thereon and prevents shearing shifts of said shoe insole while allowing selective movement of said shoe insole in certain directions so as to provide directional benefits.

3. The insole base of claim 1 wherein said sole member is of solid construction in vertical cross section so as to minimize the volume of said sole member and to provide a low volume, low profile configuration.

4. The insole base of claim 1 wherein said sole member is in the general form of a planar member to be positioned between the outsole or midsole of a shoe and the insole.

5. The insole base of claim 1 wherein said at least one raised ridge posterior to said smooth surface portion is intersected by a raised ridge which extends along the lateral side of the sole member generally parallel to the lateral edge thereof.

* * * * *